US006293391B1

(12) United States Patent
Kim

(10) Patent No.: US 6,293,391 B1
(45) Date of Patent: Sep. 25, 2001

(54) PORTABLE CASING FOR A SOAP BAR

(75) Inventor: Sung-O Kim, Seoul (KR)

(73) Assignee: Sam Heung C&T Co., Ltd. (KR)

( * ) Notice: Subject to any disclaimer, the term of this patent is extended or adjusted under 35 U.S.C. 154(b) by 0 days.

(21) Appl. No.: 09/599,986

(22) Filed: Jun. 23, 2000

(51) Int. Cl.[7] ..... A47K 5/08
(52) U.S. Cl. ..... 206/77.1; 206/385; 401/78
(58) Field of Search ..... 206/77.1, 385; 132/138; 401/68, 75, 77, 78

(56) References Cited

U.S. PATENT DOCUMENTS 2,595,403 * 5/1952 Neuschaefer .
3,623,822 * 11/1971 Davidson ..... 401/78
4,884,912 * 12/1989 Gueret ..... 401/78
5,340,225 * 8/1994 Chevassus ..... 401/78
5,399,040 * 3/1995 Holloway ..... 401/78
5,829,901 * 11/1998 Brown et al. ..... 401/75
5,863,144 * 1/1999 Ackermann ..... 401/78
6,139,208 * 10/2000 Monin-Bareil ..... 401/78

* cited by examiner

*Primary Examiner*—David T. Fidei
(74) *Attorney, Agent, or Firm*—Sheridan Ross P.C.

(57) ABSTRACT

Disclosed is a portable casing for a soap bar, which makes it easy and convenient to carry and store the soap bar, and prevents the soap bar from being broken by an external impact, thereby prolongs the life of the soap bar. The portable casing has an outer cylinder rotatably inserted in a casing body. An intermediate cylinder is fixedly inserted in the outer cylinder. At least one spiral groove is formed on an inner surface of the intermediate cylinder. An inner cylinder is fixedly inserted in the intermediate cylinder. At least one guiding groove is formed through a cylindrical wall of the inner cylinder. A carrier ring is inserted in the inner cylinder At least one guiding protuberance is formed at an outer cylindrical surface of the carrier ring. The guiding protuberance is inserted through the guiding groove in the spiral grooves. The soap bar is fitted in the carrier ring, so that the soap bar can be ascended and descended when one of the casing body and the outer cylinder is rotated.

3 Claims, 4 Drawing Sheets

PORTABLE CASING FOR A SOAP BAR

BACKGROUND OF THE INVENTION

1. Field of the Invention

The present invention relates to a soap bar, and more particularly to a portable casing for a soap bar, which makes it easy and convenient to carry and store the soap bar, and prevents the soap bar from being broken by an external impact, thereby prolonging the life of the soap bar.

2. Description of the Related Art

In general, a soap bar, which is one of the essential goods of life, is water-soluble, so that it is easily dissolved and easily deformed, and easily loses its stiffness, when it comes into contact with water.

Therefore, in order to prolong the life of the soap bar, a user has to be careful to insulate the soap bar from water when not being used, and moreover to avoid an external impact to the soap bar, The conventional soap bar generally has a rectangular or an oval shape, and is usually contained in a relatively large, hard casing or in a paper package. The large, hard casing causes inconvenience in carrying and storing the soap bar, and the paper package has the above mentioned problems in regard to the contact with water further to the inconvenience in carrying and storing the soap bar.

Moreover, the volume of the hard casing does not change in size, but remains in its same large and bulky size, although the soap bar is worn out and thus reduced in its size, accordingly as it is used. In this state where a relatively small soap bar is contained in a relatively large hard casing, the soap bar easily moves in the casing or the casing is easily broken by an external impact.

Further, a user has to directly touch the soap bar by the hand whenever he uses the soap bar. This may be an inconvenience to the user and may unnecessarily add to the wearing away of the soap bar. That is, the user necessarily has to hold the soap bar by the hand, even though he wants to apply the soap bar to only a certain region of his body such as his neck, so that the soap bar is worn out too excessively, thereby reducing its life.

SUMMARY OF THE INVENTION

Accordingly, the present invention has been made in an effort to solve the problems occurring in the related art, and it is an object of the present invention to provide a portable casing for a soap bar, which makes it easy and convenient to carry and store the soap bar, and prevents the soap bar from being broken by an external impact, thereby prolongs the life of the soap bar.

In accordance with one aspect, the present invention provides a portable casing for a soap bar, the portable casing comprising:

a casing body having a shape of a cylinder whose top is open and bottom is closed;

a fixed base fixed to the bottom of the casing body, the fixed base having a plurality of serrated arc strips fixed on an upper surface of the fixed base, each of the serrated arc strips having a first serration formed on an outer surface of each of the serrated arc strips;

an outer cylinder rotatably inserted in the casing body;

an intermediate cylinder fixedly inserted in the outer cylinder, the intermediate cylinder having at least a spiral groove formed on an inner surface of the intermediate cylinder;

an inner cylinder fixedly inserted in the intermediate cylinder, the inner cylinder having at least one guiding groove formed through a cylindrical wall of the inner cylinder, the guiding groove extending in a longitudinal direction of the inner cylinder, the inner cylinder having a serrated hole perforated through a bottom of the inner cylinder, the serrated hole having a second serration formed longitudinally at a cylindrical surface of the serrated hole, the second serration being engaged with the first serration; and a carrier ring inserted in the inner cylinder, the carrier ring having at least one guiding protuberance formed at an outer cylindrical surface of the carrier ring, the guiding protuberance being inserted through the guiding groove in the spiral grooves, wherein the soap bar is fitted in the carrier ring so that the soap bar can be ascended and descended when one of the casing body and the outer cylinder is rotated.

Preferably, the portable casing further has a lid in which the outer cylinder is detachably fitted, so that the lid covers over the upper end of the outer cylinder. The outer cylinder has a neck whose diameter is smaller than that of a remaining portion of the outer cylinder. The neck has an annular protrusion engaged with an annular groove formed at an inner cylindrical surface of the lid when the neck of the outer cylinder is detachably fitted in the lid.

More preferably, the serrated arc strips are circularly arranged so as to form together a serrated shaft at the center of the upper surface of the fixed base, which is inserted in the serrated hole of the inner cylinder.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

A preferred embodiment of the present invention will be described in detail hereinafter with reference to the accompanying drawings.

Figure 1:
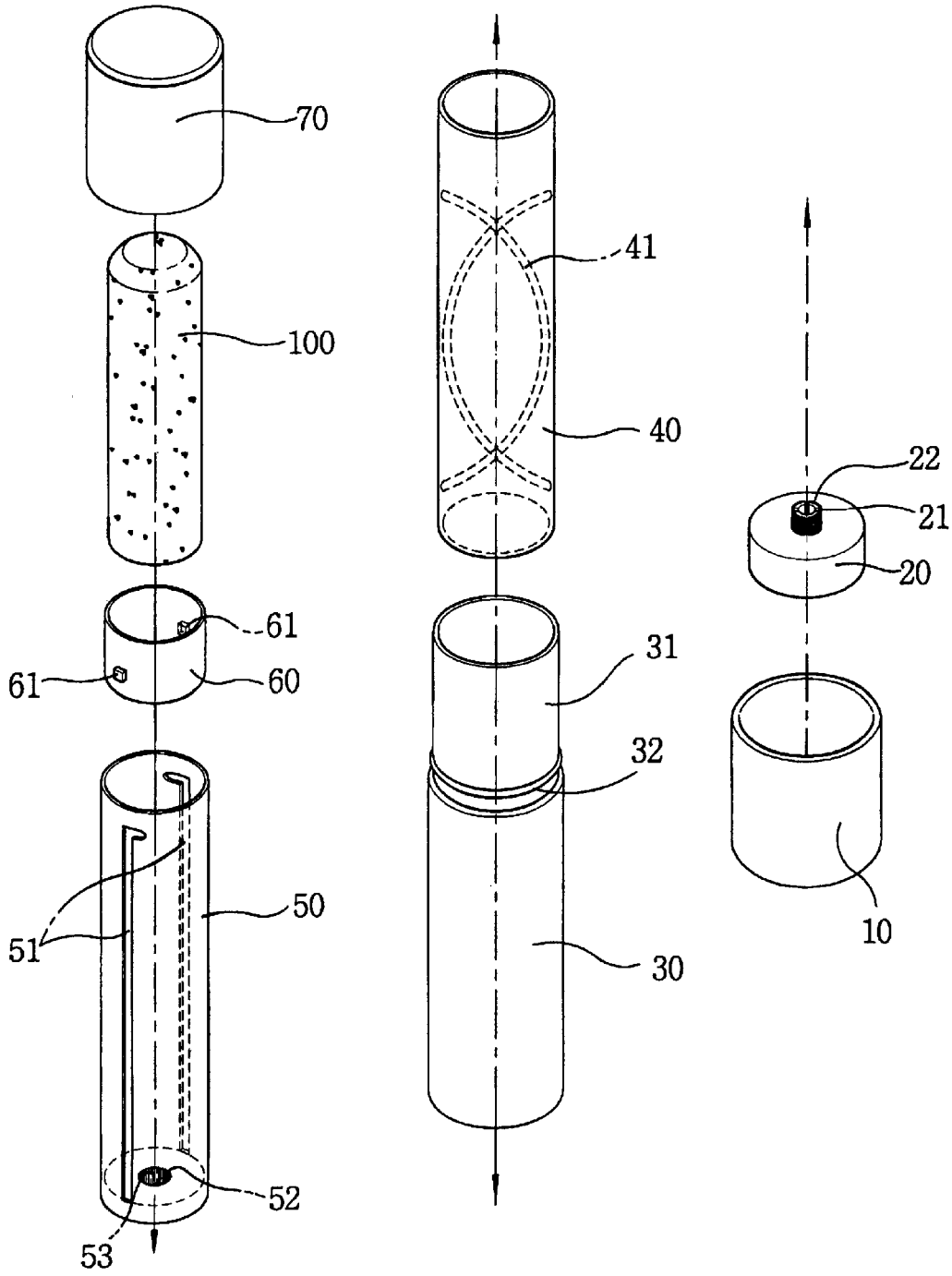
FIG. 1 is an exploded perspective view of a portable casing for a soap bar according to an embodiment of the present invention.
Figure 2:
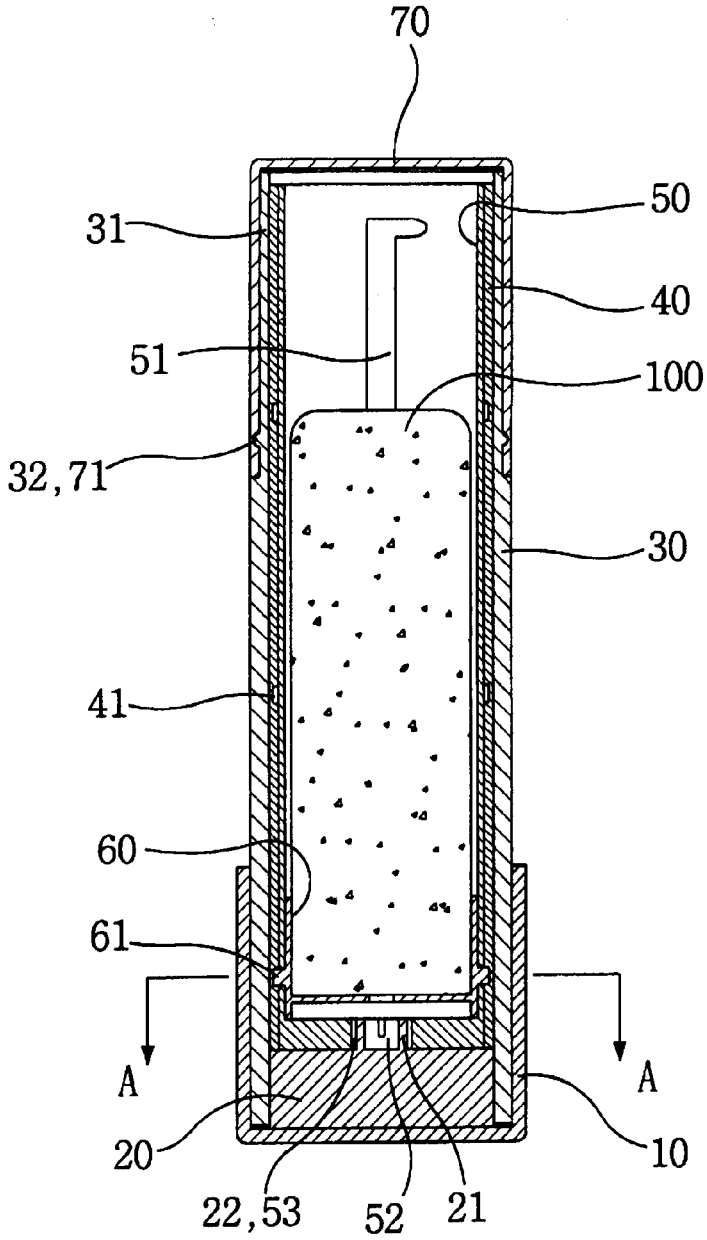
FIG. 2 is a longitudinal section of the portable casing shown in FIG. 1 in an assembled state thereof.
Figure 3:
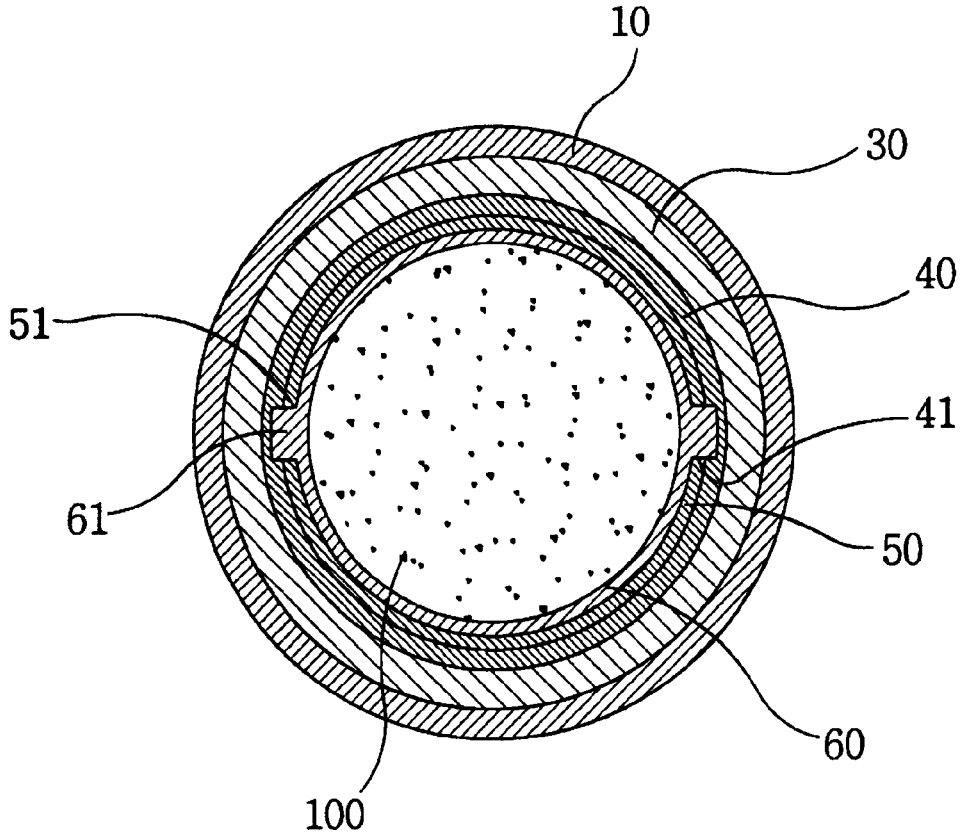
FIG. 3 is a transverse section of the portable casing shown in FIG. 1 in an assembled state thereof.

FIG. 1 is an exploded perspective view of a portable casing for a soap bar according to an embodiment of the present invention, and FIGS. 2 and 3 are longitudinal and transverse sections of the portable casing shown in FIG. 1 in an assembled state thereof.

As shown, a portable casing for a soap bar according to an embodiment of the present invention includes a casing body 10, a fixed base 20, an outer cylinder 30, an intermediate cylinder 40, an inner cylinder 50, a carrier ring 60, and a lid 70.

The casing body 10 has a shape of a cylinder whose top is open and bottom is closed.

The fixed base 20 is fixed to an inner surface of the bottom of the casing body 10, and has a plurality of serrated arc strips 21 fixed on an upper surface of the fixed base 20. Each of the serrated arc strips 21 has a first serration 22 formed on an outer surface of the serrated arc strip 21.

The outer cylinder 30 is rotatably inserted in the casing body 10, and has a shape of an elongated hollow cylinder.

The intermediate cylinder 40 having a hollow cylindrical shape is fixedly inserted in the outer cylinder 30, and has at least one spiral groove 41 formed on an inner surface of the intermediate cylinder 40.

The inner cylinder 50 also having a hollow cylindrical shape is fixedly inserted in the intermediate cylinder 40, and has at least one guiding groove 51 formed through a cylindrical wall of the inner cylinder 50 and extending longitudinally. The inner cylinder 50 has a serrated hole 52 perforated through a bottom of the inner cylinder 50. The serrated hole 52 has a second serration 53 formed longitudinally at an inner cylindrical surface of the serrated hole 52, which is engaged with the first serration 22.

The carrier ring 60 is inserted in the inner cylinder 50, and has at least one guiding protuberance 61 formed at an outer cylindrical surface of the carrier ring 60. Each guiding protuberance 61 is inserted through the guiding groove 51 in the spiral grooves 41.

A soap bar 100 having a cylindrical shape is fitted in the carrier ring 60.

The lid 70 covers over the upper end of the outer cylinder 30. That is, the outer cylinder 30 is detachably fitted in the lid 70.

The casing body 10 is made from artificial resin or metal to have a shape of a cylinder whose bottom is closed. When the portable casing for a soap bar of the invention is used, the casing body 10 functions as a rotating body.

The fixed base 20 is inserted in and firmly fixed to the bottom of the casing body 10. The plurality of the serrated arc strips 21 are integrally formed with the fixed base 20, and are circularly arranged so as to form together a serrated shaft, which is inserted in the serrated hole 52, at the center of the upper surface of the fixed base 20.

The lower end of the outer cylinder 30 is rotatably fitted between the casing body 10 and the fixed base 20 fixed in the casing body 10. The outer cylinder 30 has a neck 31 whose diameter is smaller than that of the lower portion of the outer cylinder 30. The neck 31 is integrated with an upper end of the lower portion of the outer cylinder 30 which is a main portion of the outer cylinder 30. The neck 31 has an annular protrusion 32 formed near a lower end of the neck 31. When the neck 31 of the outer cylinder 30 is detachably fitted in the lid 70, the annular protrusion 32 is engaged with an annular groove 71 formed at an inner cylindrical surface of the lid 70.

The intermediate cylinder 40 is firmly fixed to an inner surface of the outer cylinder 30, and at least one spiral groove 41 is formed on the inner surface of the intermediate cylinder 40.

The inner cylinder 50 is rotatably inserted in the intermediate cylinder 40, and the guiding groove 51 extending longitudinally is formed through a cylindrical wall of the inner cylinder 50. The serrated hole 52 is perforated through the bottom of the inner cylinder 50 and the second serration 53 is formed longitudinally at the inner cylindrical surface of the serrated hole 52. The second serration 53 is engaged with the first serration 22.

As shown in FIG. 2, the carrier ring 60 defines a recess whose upper end is open, and a hole having a small diameter is formed through the bottom of the carrier ring 60. The guiding protuberance 61 is formed at the outer cylindrical surface of the carrier ring 60 and is inserted through the guiding groove 51 in the spiral grooves 41.

The soap bar 100 has a shape of a cylindrical rod and is received in the recess of the carrier ring 60.

As shown in FIGS. 2 and 3, when elements of the portable casing are assembled together, the fixed base 20 is firstly fixed to the inner surface of the bottom of the casing body 10, and the outer cylinder 30 is rotatably inserted between the casing body 10 and the fixed base 20.

Then, the intermediate cylinder 40 is inserted and fixed in the outer cylinder 30, and the inner cylinder 50 is inserted in the intermediate cylinder 40 so that the first serration 22 of the fixed base 20 is engaged with the second serration 53 of the inner cylinder 50.

Thereafter, the soap bar 100 is received in the carrier ring 60, and the carrier ring 60 receiving the soap bar 100 is inserted in the inner cylinder 50 in such a manner that the guiding protuberance 61 of the carrier ring 60 is inserted through the guiding groove 51 in the spiral grooves 41.

Finally, the neck 31 of the outer cylinder 30 is inserted in the lid 70 so that the annular protrusion 32 of the neck 31 is engaged with the annular groove 71 of the lid 70. Then, the lid 70 is firmly fitted around the outer cylinder 30 and is prevented from separating therefrom without an external force intentionally applied thereto. In this case, the lid 70 covers the soap bar 100 received in the outer cylinder 30, so as to prevent the soap bar 100 from being exposed to the exterior.

Hereinafter, described will be the operation of the portable casing for a soap bar according to the present invention.

In the state where the portable casing is assembled as shown in FIG. 2, when a user takes off the lid 70 and rotates the casing body 10, the fixed base 20 is also rotated together with the casing body 10.

When the fixed base 20 is rotated, the inner cylinder 50 connected through the first serration 22 and the second serration 53 to the fixed base 20 is also rotated, so that the carrier ring 60 is rotated by means of the guiding protuberance 61 inserted in the guiding groove 51 of the inner cylinder 50.

In this case, since the guiding protuberance 61 of the carrier ring 60 is inserted through the guiding groove 51 in the spiral grooves 41 of the intermediate cylinder 40 fixed in the outer cylinder 30, the guiding protuberance 61 is ascended along the spiral grooves 41 while being rotated by the inner cylinder 50.

Figure 4:
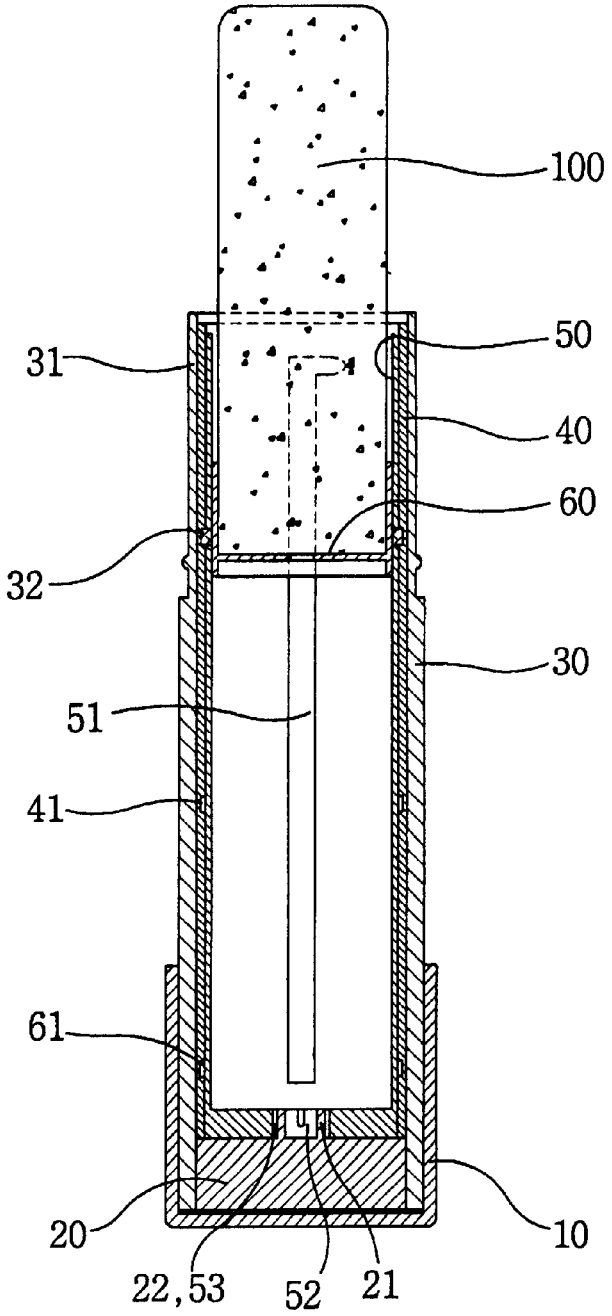
FIG. 4 is a longitudinal section similar to FIG. 2, which shows a soap bar protruding out of the portable casing.

According to the rotation of the carrier ring 60, the soap bar 100 received in the carrier ring 60 is also ascended as shown in FIG. 4. Therefore, the user can go on rotating the casing body 10 until a desired length of the soap bar 100 protrudes out of the outer cylinder 30.

In the state where the soap bar 100 is drawn out of the outer cylinder 30 by a desired length, the user can use the soap bar 100 in applying a desired region such as a portion of his body.

After using the soap bar 100, the user can rotate the casing body 10 in the opposite direction to the above, so that the soap bar 100 is retreated into the outer cylinder 30. When the soap bar 100 is completely retreated in the outer cylinder 30, the user can put the lid 70 onto the outer cylinder 30, so as to prevent the soap bar 100 from being exposed as in the initial stage.

In the state where the lid 70 is put on, the user can carry the soap bar with the portable casing in a pocket or in a handbag, or can store it in a separate place.

In operating the portable casing of the invention, the soap bar 100 is drawn out and retreated into the outer cylinder 30 by rotating the outer cylinder 30 instead of the casing body 10.

As described above, by the portable casing for a soap bar of the present invention, a soap bar can be stored in the casing on the norm, and can be used after being drawn out of the casing whenever it is necessary. Therefore, the portable casing for a soap bar of the present invention makes it easy and convenient to carry and store the soap bar, and prevents the soap bar from being broken by an external impact while being carried.

Further, by the portable casing for a soap bar of the present invention, a user can apply the soap bar onto a desired region, such as a portion of his body, without directly touching the soap bar. Therefore, the portable casing of the present invention makes it easy to use and to apply the soap bar, and prevents the soap bar from being worn out rapidly.

Moreover, the portable casing for a soap bar of the present invention prevents the soap bar from being in contact with water while the soap bar is stored and carried in the casing, thereby preventing the soap bar from being deformed and broken. This characteristic has an economically advantageous effect.

While there has been illustrated and described what is considered to be a preferred specific embodiment of the present invention, it will be understood by those skilled in the art that the present invention is not limited to the specific embodiment thereof, and various changes and modifications and equivalents may be substituted for elements thereof without departing from the true scope of the present invention.

What is claimed is:

1. A portable casing for a soap bar, the portable casing comprising:

a casing body having a shape of a cylinder whose top is open and bottom is closed;

a fixed base fixed to the bottom of the casing body, the fixed base having a plurality of serrated arc strips fixed on an upper surface of the fixed base, each of the serrated arc strips having a first serration formed on an outer surface of each of the serrated arc strips;

an outer cylinder rotatably inserted in the casing body;

an intermediate cylinder fixedly inserted in the outer cylinder, the intermediate cylinder having at least one spiral groove formed on an inner surface of the intermediate cylinder;

an inner cylinder fixedly inserted in the intermediate cylinder, the inner cylinder having at least one guiding groove formed through a cylindrical wall of the inner cylinder, the guiding groove extending in a longitudinal direction of the inner cylinder, the inner cylinder having a serrated hole perforated through a bottom of the inner cylinder, the serrated hole having a second serration formed longitudinally at a cylindrical surface of the serrated hole, the second serration being engaged with the first serration;

a carrier ring inserted in the inner cylinder, the carrier ring having at least one guiding protuberance formed at an outer cylindrical surface of the carrier ring, the guiding protuberance being inserted through the guiding groove in the spiral grooves; and a lid in which the outer cylinder is detachably fitted, so that the lid covers over the upper end of the outer cylinder, wherein the soap bar is fitted in the carrier ring so that the soap bar can be ascended and descended when one of the casing body and the outer cylinder is rotated.

2. A portable casing as claimed in claim 1, wherein the outer cylinder has a neck whose diameter is smaller than that of a remaining portion of the outer cylinder, the neck having an annular protrusion engaged with an annular groove formed at an inner cylindrical surface of the lid when the neck of the outer cylinder is detachably fitted in the lid.

3. A portable casing as claimed in claim 1, wherein the serrated arc strips are circularly arranged so as to form together a serrated shaft at the center of the upper surface of the fixed base, which is inserted in the serrated hole of the inner cylinder.

* * * * *